US008214938B2

(12) United States Patent
Hanley et al.

(10) Patent No.: US 8,214,938 B2
(45) Date of Patent: Jul. 10, 2012

(54) SHOWER BAR ASSEMBLY

(75) Inventors: Michael Hanley, Smithfield, RI (US); Leo E. LaBarre, Woonsocket, RI (US); Sally Voas, Albion, RI (US)

(73) Assignee: Kenney Manufacturing Company, Warwick, RI (US)

( * ) Notice: Subject to any disclaimer, the term of this patent is extended or adjusted under 35 U.S.C. 154(b) by 1271 days.

(21) Appl. No.: 11/536,780

(22) Filed: Sep. 29, 2006

(65) Prior Publication Data

US 2008/0078018 A1 Apr. 3, 2008

(51) Int. Cl.
*A47K 3/00* (2006.01)

(52) U.S. Cl. ..... 4/610; 248/261; 248/264

(58) Field of Classification Search ..... 4/557–558, 4/607–610; 221/180, 105.1; 248/261–265; 5/557–558, 607–610
See application file for complete search history.

(56) References Cited

U.S. PATENT DOCUMENTS

| | | | | |
|---|---|---|---|---|
| 839,959 | A * | 1/1907 | Richards | 248/262 |
| 1,953,450 | A * | 4/1934 | Thompson | 248/263 |
| 2,215,331 | A * | 9/1940 | Marsh | 248/251 |
| 5,022,104 | A | 6/1991 | Miller | |
| D397,928 | S | 9/1998 | Wise | |
| 5,894,610 | A | 4/1999 | Winter | |
| D426,142 | S | 6/2000 | Moore | |
| 6,216,287 | B1 | 4/2001 | Wise | |
| 6,263,523 | B1 | 7/2001 | Moore | |
| 6,845,955 | B1 * | 1/2005 | Hsu | 248/200.1 |

OTHER PUBLICATIONS

Image of Jarfey Ranch Bath House; The Bancroft Library, University of California, Berkley; website address <http://sunsite.berkeley.edu/FindingAids/dynaweb/calher/crossagr/figures/10015431A.jpg> Publication Date Apr. 3, 2002 (established from the Internet Archive Wayback Machine www.archive.org).*

* cited by examiner

*Primary Examiner* — Gregory Huson
*Assistant Examiner* — Janie Christiansen
(74) *Attorney, Agent, or Firm* — Steven M. McHugh

(57) ABSTRACT

A shower bar assembly that includes a pair of mounting brackets configured and arranged to be mounted to a wall of a shower stall is disclosed. Each of the mounting brackets has a base portion with a first shelf and a second shelf projecting from the base portion. The first and second shelves each have a retaining peg projecting from each shelf, respectively. A tubular shower bar is included and has two opposing ends. Each of the ends of the tubular shower bar has a pair of surfaces in which each defines an aperture through the tubular shower bar. Each end of the tubular shower bar is configured and arranged to slide onto the first and second shelves of the mounting brackets, with the apertures interlocking with each of the retaining pegs, respectively, to suspend the shower bar between the mounting brackets and to prevent the shower bar from rotating between the brackets.

16 Claims, 6 Drawing Sheets

SHOWER BAR ASSEMBLY

BACKGROUND OF THE INVENTION

1. Field of the Invention

The present invention relates generally to shower bar assemblies and more particularly to a kit for mounting a shower bar in a shower stall to expand the usable space within a shower stall in a secure manner.

2. Background of the Related Art

In the construction of most bathrooms, it is common to position a shower nozzle mounted on the wall at an enclosure above a bath tub to thereby provide the option of a shower for the resident using the bathroom facility. In defining such enclosures, splashing water out of the enclosure is limited by the use of a sliding door, typically a translucent plastic or shatter proof glass, or more conveniently, a shower curtain supported by a shower bar or rod. The shower curtain is ordinarily constructed and arranged to drape loosely from a set of eyelets or curtain rings, which slide along the shower bar. A set of such rings is normally mounted slidably on the shower bar, which is positioned normally at the height of the sprinkler head or other nozzle. The shower curtain is draped in the bath tub below so that water is not splashed out of the bath tub. Because the bath tub is below the shower nozzle, the bath tub functions to collect water which drains from the bath tub during the shower.

However, it is also desirable in the art to create a shower bar or rod that expands the usable area inside the shower stall. For oval and other differently-shaped bath tubs, prior art inventors have created shower bars having different shapes, such as arcs or having S-shaped curves in them, not only to capture shower spray, but also to ensure that the resident user is not crowded by the closeness of the shower curtain. Not only does this feature prevent the resident user from feeling claustrophobic in the shower, but it also gives them a larger degree of freedom of movement within the shower stall proper. However, creating a shower bar that is other than a straight bar creates its own new problems. In particular, the bar cannot be allowed to rotate within its mounting brackets or the desired expanded area would be compressed and water from the shower spray may exit the enclosure creating an undesirable mess. U.S. Pat. No. 6,216,287, issued to Wise, and U.S. Pat. No. 5,022,104, issued to Miller, are two prior art examples that have attempted to solve these problems.

The '287 patent discloses a shower curtain rod having two end portions with angled fittings to enable the shower curtain rod to be attached between a pair of parallel walls at a bath tub enclosure or shower stall. The '287 shower curtain rod is constructed with a central portion curving to follow the edge or profile of an oval or elliptical bath tub. This curving central portion enables the shower curtain to hang into the bath tub. Because the fittings are angled and the shower bar itself is curved, the shower curtain rod is kept in a fixed rotational position.

The '104 patent discloses a shower curtain support that has a shower curtain rod mounted by opposing wall brackets on parallel end walls of a shower stall. The rod has S-shaped ends to expand the useable space within the shower stall and slidably suspends a conventional shower curtain across the front opening of the shower stall. "Spiders" on the terminal ends of the rod are indexably received by "spider plates" of the wall brackets to dispose the rod in a number of radial orientations relative to the wall brackets, and are referred to as "spider means." Because the "spiders" interlock with the "spider plates," the rod is kept in a fixed rotational position.

Although both the '287 and '104 patents present solutions to the aforementioned problems of expanding the usable space within a shower stall and also holding the shower bar in a fixed rotational plane, it is believed that there is still a need in the industry for yet another means for mounting a shower bar within a shower stall or bath tub enclosure that solves these problems.

Additionally, there is a perceived need for a shower bar assembly that can be installed easily by homeowners. In particular, because many homeowners maintain their own households, they require a shower bar assembly that can be installed with few or only basic tools and with minimal skill.

SUMMARY OF THE INVENTION

The present invention solves this need within the industry by providing a shower bar assembly that includes a pair of mounting brackets configured and arranged to be mounted to a wall of a shower stall. Each of the mounting brackets has a base portion with a first shelf and a second shelf projecting from the base portion. The first shelves and the second shelves each have a retaining peg projecting from each shelf, respectively. A tubular shower bar is included and has two opposing ends. Each of the ends of the tubular shower bar has a pair of surfaces in which each defines an aperture through the tubular shower bar. Each end of the tubular shower bar is configured and arranged to slide onto the first and second shelves of the mounting brackets, with the apertures interlocking with each of the retaining pegs, respectively, to suspend the shower bar between the mounting brackets and to prevent the rotation thereof.

Accordingly, among the objects of the present invention is the provision for a shower bar assembly that expands the usable space within a shower stall.

Another object of the present invention is the provision for a shower bar assembly that suspends a shower bar in a fixed rotational position within a shower stall.

Yet another object of the present invention is the provision for a mounting bracket that can suspend a shower bar in a shower stall in a fixed rotational position.

Yet another object of the present invention is the provision for a shower bar assembly that requires few or basic tools to install it properly.

Yet another object of the present invention is the provision for a shower bar assembly that can be installed with little training and/or skill.

BRIEF DESCRIPTION OF THE DRAWINGS

These and other features, aspects, and advantages of the present invention will become better understood with reference to the following description, appended claims, and accompanying drawings where:

DESCRIPTION OF THE PREFERRED EMBODIMENT

Figure 1:
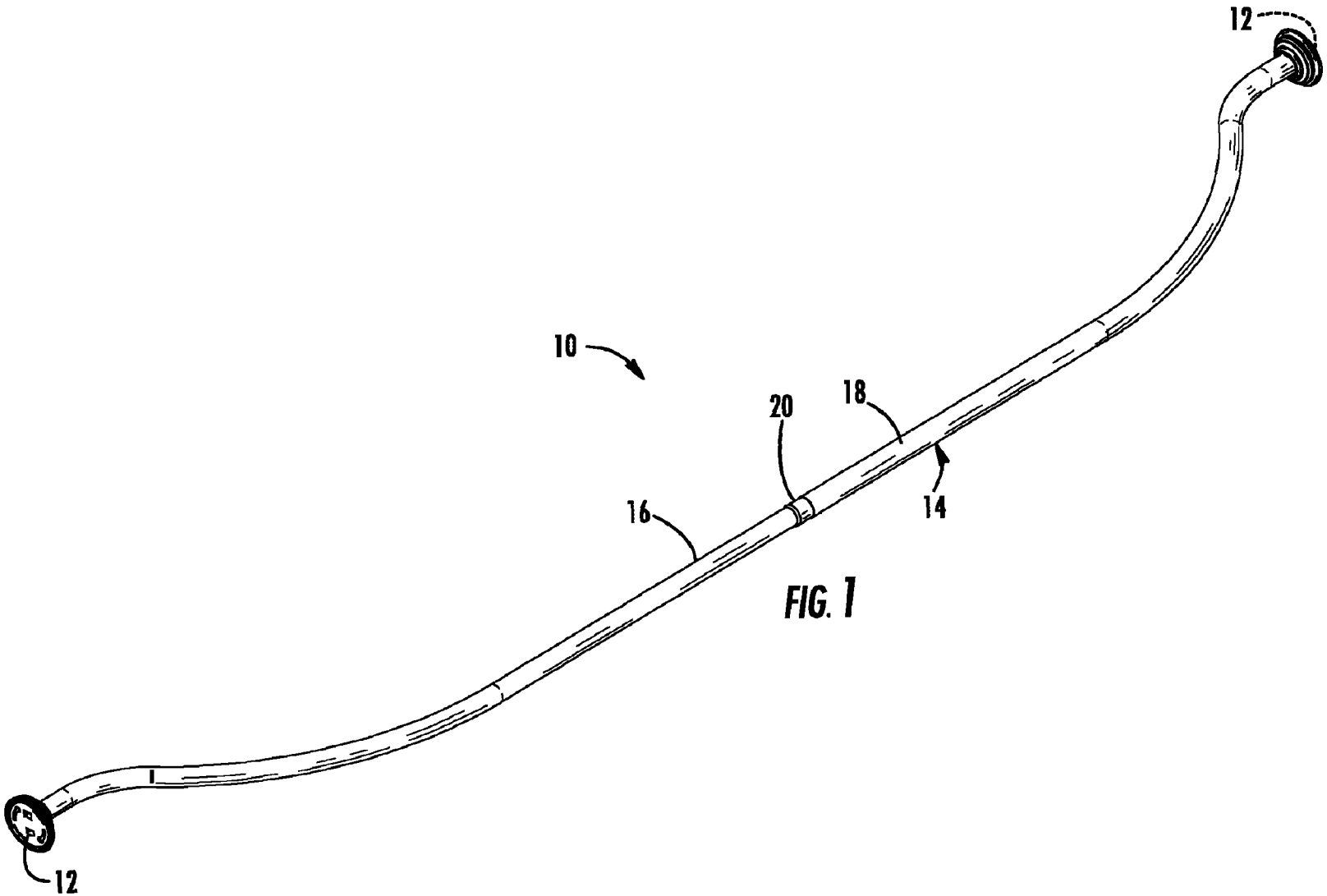
FIG. 1 is a perspective view of the preferred embodiment of the shower bar assembly of the present invention.
Figure 2:
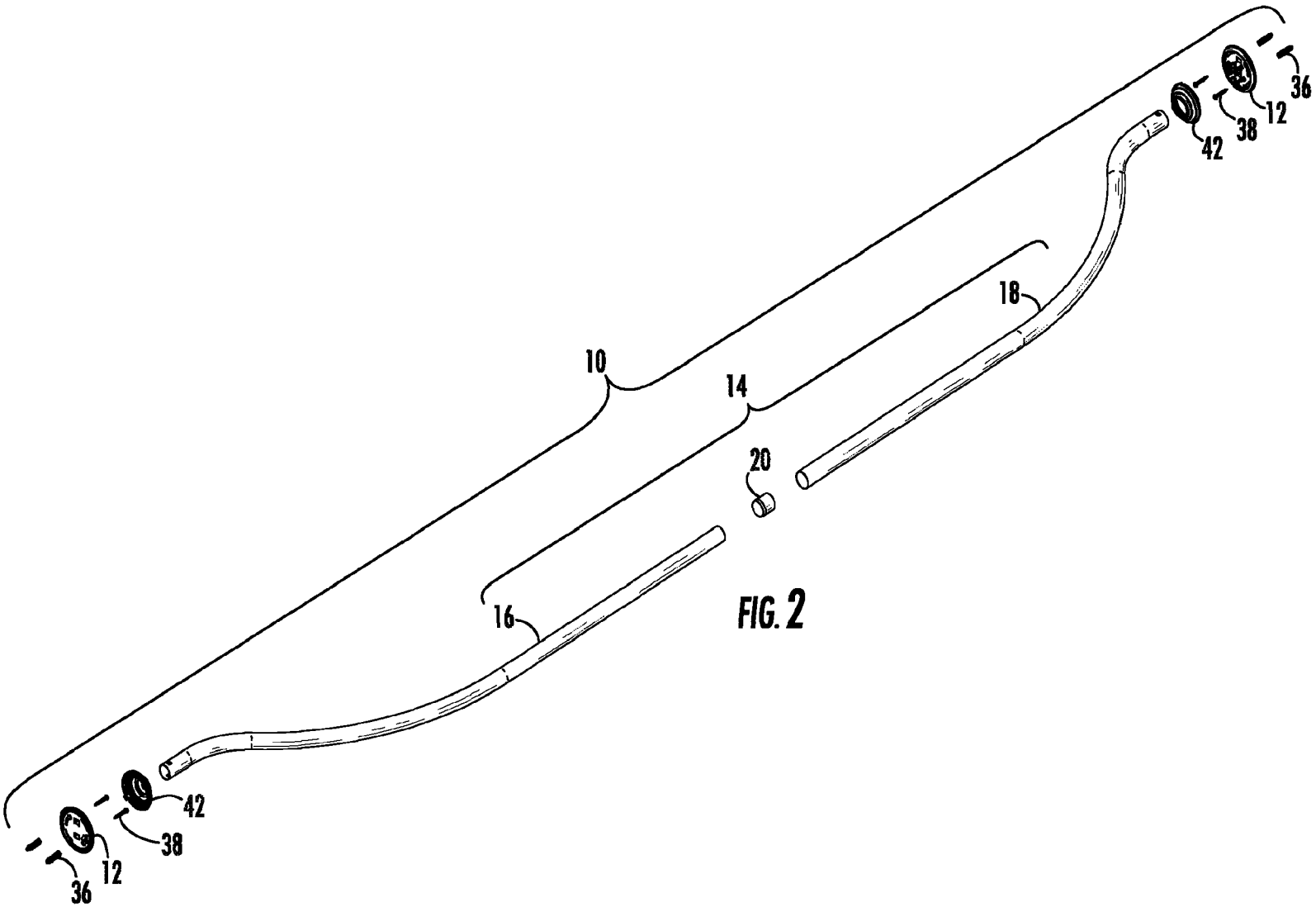
FIG. 2 is an exploded view of the assembly shown in FIG. 1.

Referring to FIGS. 1 and 2, the shower bar assembly of the present invention is shown generally at 10. As will be described in greater detail below, the shower bar assembly of the present invention includes a pair of mounting brackets 12 configured and arranged to be mounted to a wall of a shower stall. A tubular shower bar 14 is suspended between the mounting brackets 12 and is preferably telescopically adjustable.

Specifically, the tubular shower bar portion 14 is preferably formed from two halves 16, 18 that may couple together to allow the overall length of the shower bar 14 to be adjusted telescopically to the desired size. Although a cylindrical shower bar is preferred, any tubular shape may be used. A compression fitting 20 is provided to fix the shower bar at the desired length. The shower bar portion 14 has "S"-shaped ends to enable the shower bar 14 to expand the usable space within the shower stall. Although S-shaped ends are shown, other configurations could be used, such as a uniformly curved shower bar, for instance.

Figure 3:
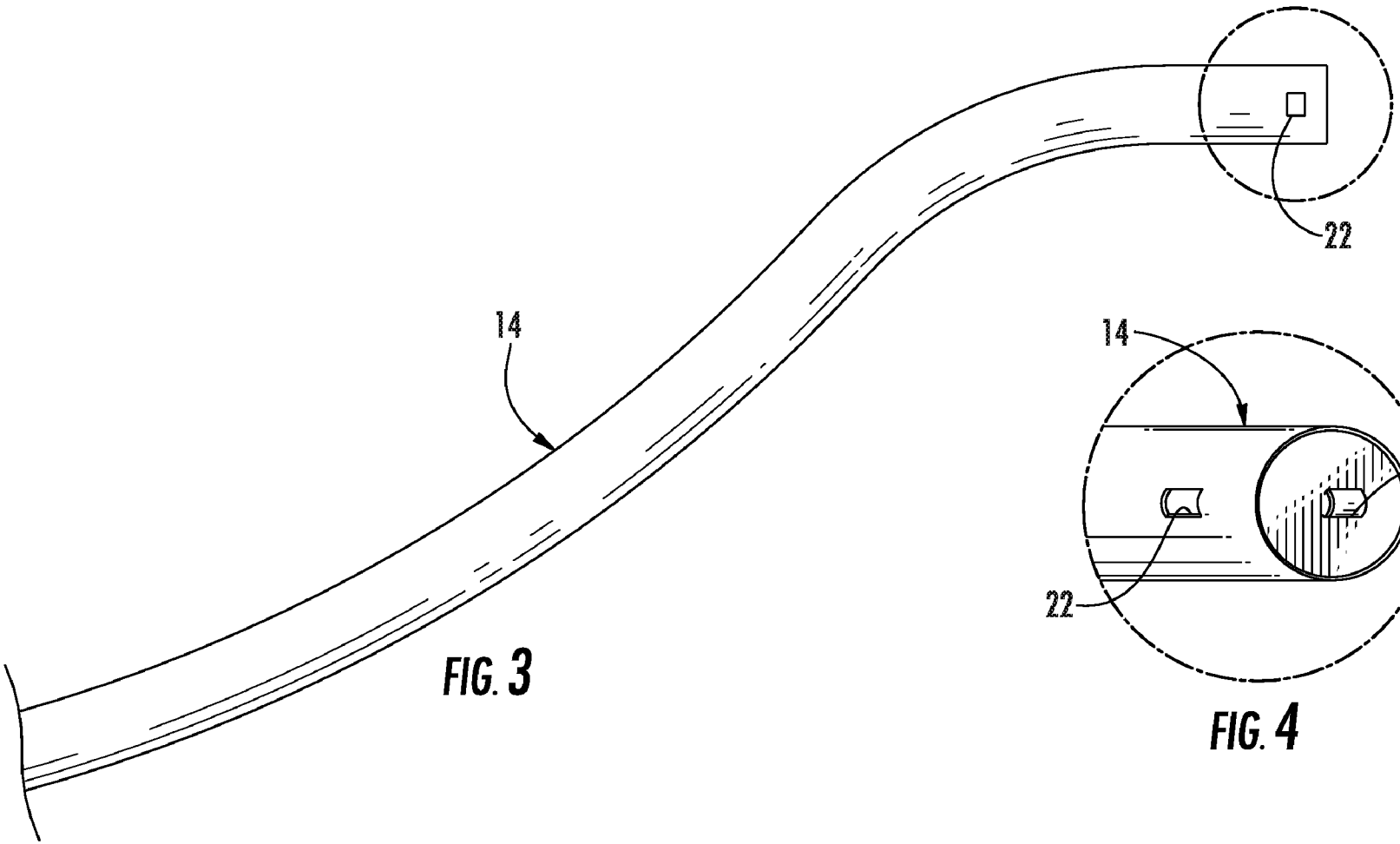
FIG. 3 is a close up view of one end of the shower bar, the opposite end being the mirror image thereof.
Figure 4:
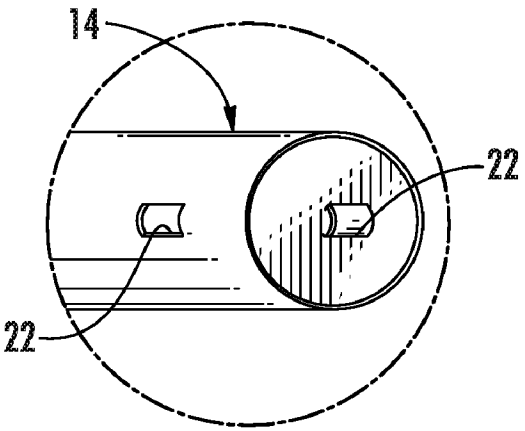
FIG. 4 is a close-up perspective view of the area circled in a dashed line in FIG. 3.

Referring now to FIGS. 3 and 4, at either end of the shower bar 14 a pair of apertures 22 is formed through the shower bar 14 to enable the shower bar 14 to be suspended in the mounting brackets 12. Although the apertures 22 are shown opposing each other and are square, they could be circular, triangular, or any other shape. Similarly, the apertures need not necessarily be opposing one another, but could be offset from one another as well. As will be described further below, the apertures 22 on the shower bar 14 cooperate with the mounting brackets 12 to suspend the shower bar 14 therebetween.

Figure 5:
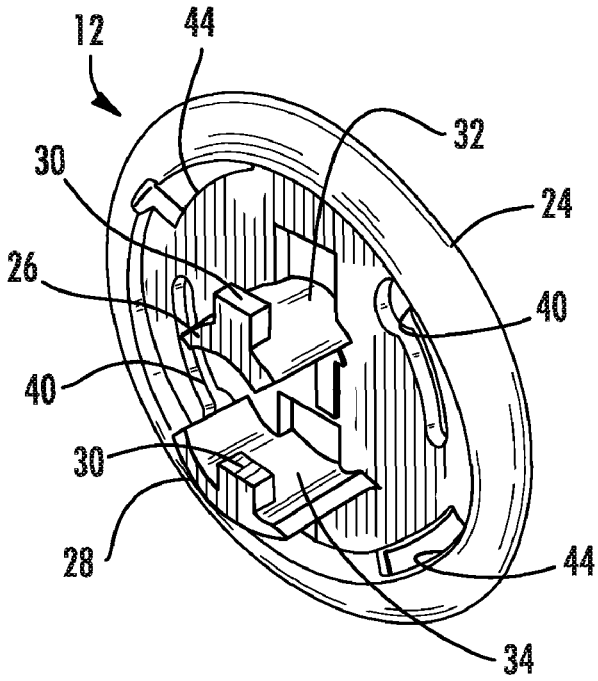
FIG. 5 is a perspective view of one of the mounting brackets of the assembly of the present invention.
Figure 6:
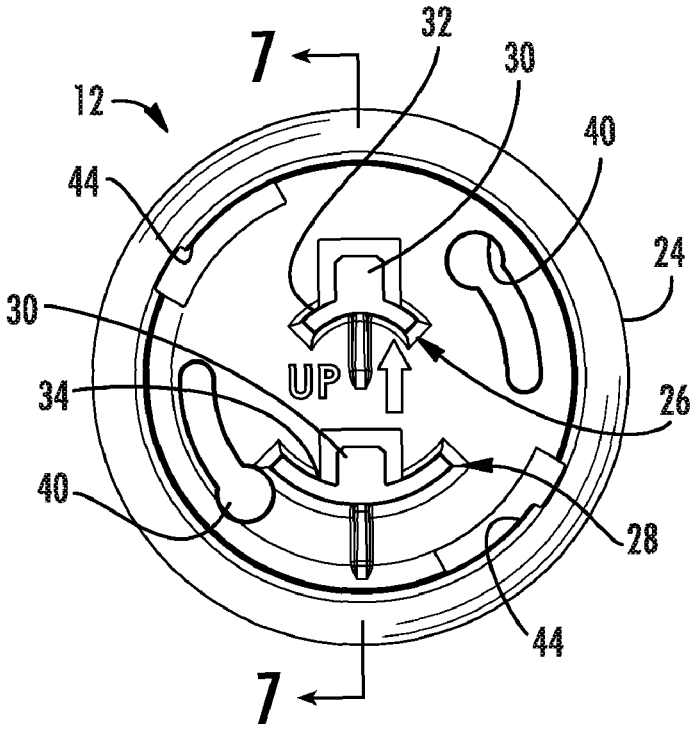
FIG. 6 is a front view of the mounting bracket shown in FIG. 5.
Figure 7:
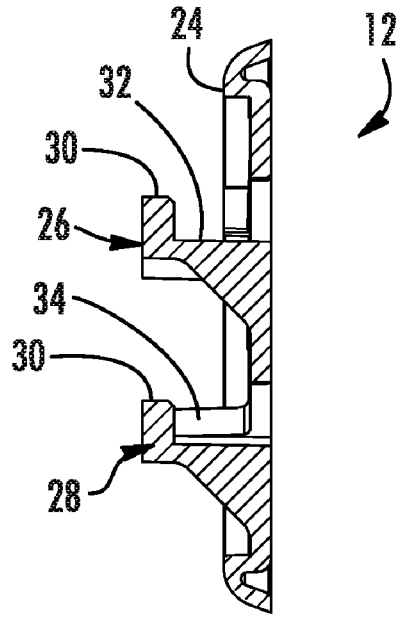
FIG. 7 is a cross-section view taken through line 7-7 of FIG. 5.

Referring now to FIGS. 5, 6 and 7, the mounting bracket is shown generally at 12. The mounting bracket 12 has a base portion 24 and a pair of horizontally projecting shelves, an upper shelf 26 and a lower shelf 28. Each shelf 26, 28 has an upwardly projecting retaining peg 30 configured to cooperate with the apertures 22 on the shower bar 14. The upper shelf 26 has an upper surface 32 that is convex in order to cradle the upper portion of the end of the shower bar 14. Similarly, the lower shelf 28 also has an upper surface 34 to cradle the lower portion of the end of the shower bar 14, however, it is concave. One skilled in the art would appreciate the fact that the shelves 26, 28 could have other shaped surfaces in order to tubular support shower bars that are not cylindrical. For instance, the surfaces 32, 34 could have a V-shape and inverted V-shape, respectively, to cradle a tubular shower bar with a diamond cross-section.

Preferably, the user attaches the mounting brackets 12 to the shower stall wall or bath tub enclosure wall using plastic anchors 36 and screw-type fasteners 38 (shown in FIG. 2). However, the actual fastening system used may vary depending upon the material of surface the shower bar assembly 10 is to be mounted to. The mounting brackets 12 have a first pair of keyed openings 40 formed on the base portion 24 (best send in FIG. 6), that are configured to slidably couple to the screw-type fasteners 38. Any conventional means of attaching the mounting brackets 12 to a wall can be used and any particular method of attaching the mounting bracket 12 to the wall used is not critical to the inventive concepts described herein.

Figure 8:
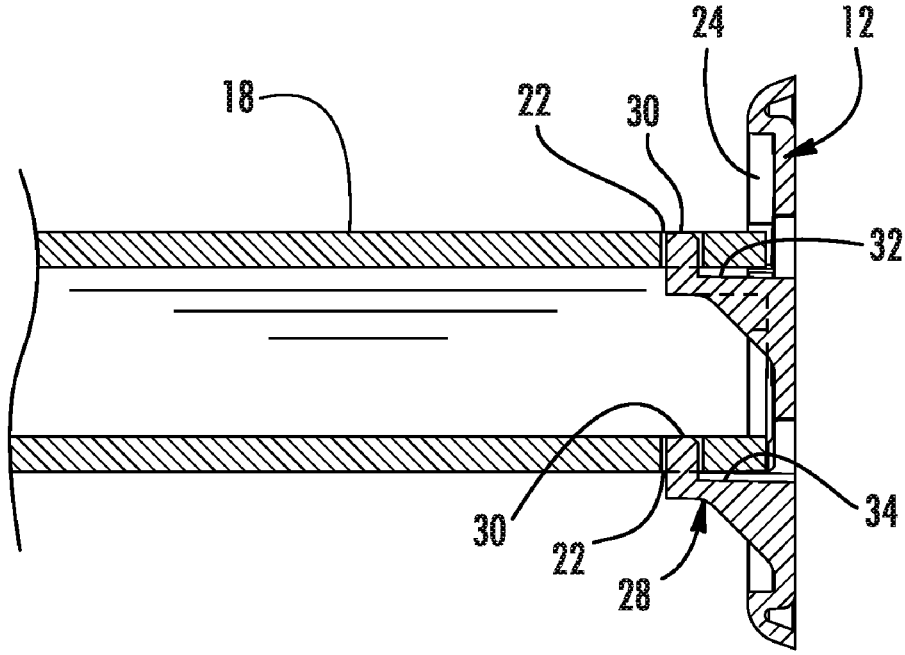
FIG. 8 is a side cross-section view of one end the shower bar coupled to one mounting bracket.
Figure 9:
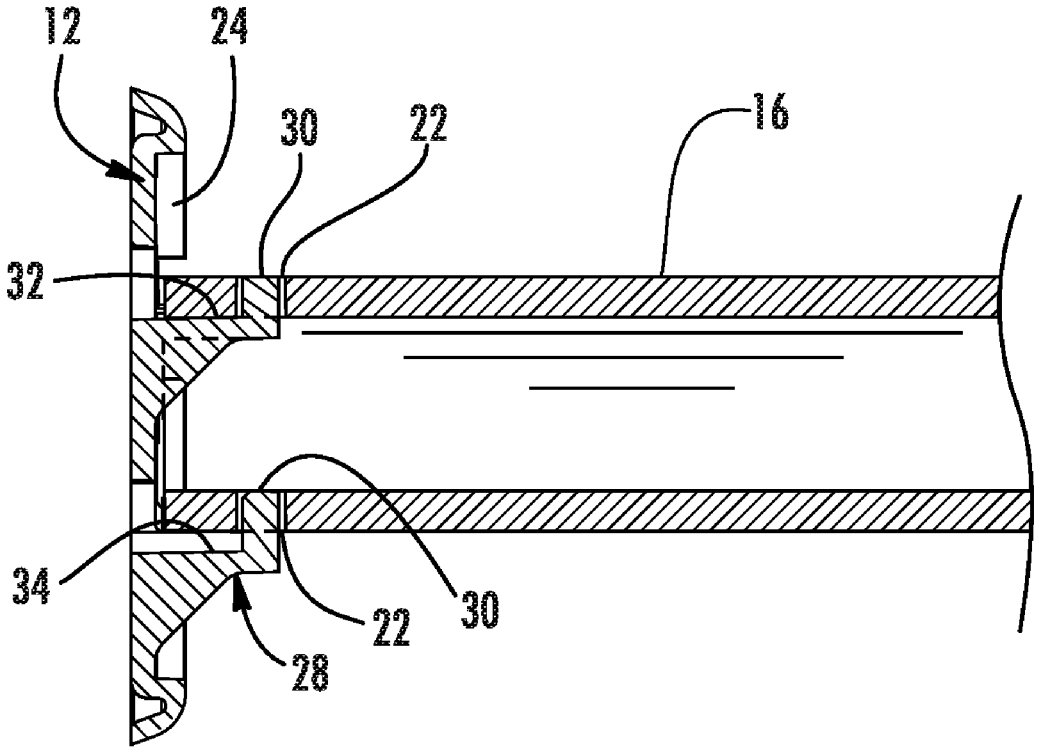
FIG. 9 is a side cross-section view of the opposite end of the shower bar coupled to the other opposing mounting bracket

As shown in FIGS. 8 and 9, the tubular shower bar 14 cooperates with the shelves 26, 28 on the mounting bracket 12 to suspend the shower bar 14 between the mounting brackets 12.

Referring to FIG. 8, the retaining peg 30 on the lower shelf 28 cooperates with one of the apertures 22 on the wider portion 18 the shower bar 14 to prevent the shower bar 14 from sliding off of the lower shelf 28, while the concave lower surface 34 on the lower shelf 28 supports the lower portion 18 of the end of the shower bar 14. Similarly, the retaining peg 30 on the upper shelf 26 cooperates with the other free aperture 22 on the end 18 of the shower bar 14 to prevent the shower bar 14 from rotating.

Referring to FIG. 9, the retaining peg 30 on the upper shelf 26 cooperates with one of the apertures 22 on narrower portion 16 the shower bar 14 to prevent the shower bar 14 from sliding off of the upper shelf 26, while the convex upper surface 32 on the upper shelf 26 supports the upper portion of the end of the shower bar 14. Similarly, the retaining peg 30 on the lower shelf 28 cooperates with the other free aperture 22 on the end of the shower bar 14 to prevent the shower bar 14 from rotating.

Because the two retaining pegs 30 cooperate with the apertures 22 of the end 18 of the tubular shower bar 14, respectively, the shower bar 14 is held in a fixed rotational position between the mounting brackets 12.

One skilled in the art would appreciate the fact that a shower bar 14 formed with a uniform diameter could be configured to rest on both the lower and the upper shelves 26, 28.

With the shower bar 14 suspended in the brackets 12, decorative cowlings 42 (best seen in FIG. 1) are used to beautify the overall appearance of the shower bar assembly 10 and to hide the mounting brackets 12 and fasteners 28 from view. The mounting brackets 12 have a second pair of keyed openings 44 formed on the base portion 24 (best seen in FIG. 6), which are configured to slidably receive a corresponding pair of tabs (not shown) on the cowling 42.

Therefore, it can be seen that the present invention provides a unique solution to the problem of providing a shower bar assembly that expands the usable space within the shower bar and suspends the shower bar in a secure manner. Moreover, the shower bar assembly of the present invention requires few tools and little skill to install. In fact, the only tools required are those to install the fasteners for attaching the mounting brackets to the shower stall, which may be as little as a cordless drill and a screwdriver. As can be appreciated, cordless drills and screwdrivers are easy for most individuals to operate safely and effectively.

It would be appreciated by those skilled in the art that various changes and modifications can be made to the illustrated embodiments without departing from the spirit of the present invention. All such modifications and changes are intended to be within the scope of the present invention except as limited by the scope of the appended claims.

What is claimed is:

1. A shower bar assembly, comprising:

a pair of mounting brackets configured and arranged to be mounted to a wall of a shower stall;

each of said mounting brackets having a base portion with a first shelf and a second shelf extending from said base portion, said first shelf having an upwardly facing convex surface;

each of said first shelves and said second shelves having a retaining peg projecting therefrom, respectively;

a tubular shower bar having two opposing ends;

each of said ends of said tubular shower bar having a pair of surfaces each defining an aperture therethrough;

each of said ends of said tubular shower bar configured and arranged to slide onto each of said first shelves and said second shelves of said mounting brackets such that said retaining pegs interfit with each of said apertures, respectively, to suspend said tubular shower bar between said mounting brackets and prevent the rotation thereof.

2. The assembly of claim 1, wherein said tubular shower bar has a circular cross-section.

3. The assembly of claim 1, wherein said shower bar has a curved portion.

4. The assembly of claim 1, wherein each of said second shelves have an upwardly facing concave surface.

5. The assembly of claim 1, further comprising a pair of cowlings configured and arranged to cover each of said mounting brackets and said ends of said tubular shower bar, respectively.

6. The assembly of claim 1, wherein said tubular shower bar is telescopically adjustable.

7. A shower bar assembly, comprising:

a pair of mounting brackets configured and arranged to be mounted to a wall of a shower stall;

each of said mounting brackets having a base portion with an upper shelf and a lower shelf extending horizontally from said base portion;

each of said upper shelves and lower shelves having an upwardly projecting retaining peg, respectively;

a tubular shower bar having two opposing ends;

each of said ends of said tubular shower bar having a pair of surfaces each defining an aperture therethrough;

each of said ends of said tubular shower bar configured and arranged to slide onto each of said upper shelves and lower shelves of said mounting brackets such that said retaining pegs interfit with each of said apertures, respectively, to suspend said tubular shower bar between said mounting brackets and to prevent the rotation thereof, wherein when said tubular shower bar is associated with said mounting bracket such that said retaining pegs are interfit with said apertures, an outer portion of of said tubular shower bar is resting on a surface of said lower shelf.

8. The assembly of claim 7, wherein said tubular shower bar has a circular cross-section.

9. The assembly of claim 7, wherein said shower bar has a curved portion.

10. The assembly of claim 7, wherein each of said upper shelves have an upwardly facing convex surface.

11. The assembly of claim 7, wherein each of said lower shelves have an upwardly facing concave surface.

12. The assembly of claim 7, further comprising a pair of cowlings configured and arranged to cover each of said mounting brackets and said ends of said tubular shower bar, respectively.

13. The assembly of claim 7, wherein said tubular shower bar is telescopically adjustable.

14. A mounting bracket for a shower bar, comprising:

a base portion configured and arranged to be coupled to a wall of a shower stall;

a first shelf extending from said base portion, said first shelf having a first retaining peg projecting from said first shelf and an upwardly facing convex surface;

a second shelf extending from said base portion, said second shelf having a second retaining peg projecting from said second shelf;

said first shelf and said second shelf configured and arranged to receive a tubular shower bar thereon wherein said first retaining peg and said second retaining peg cooperate with said tubular shower bar to removably secure said shower bar to said mounting bracket and prevent the rotation thereof; wherein at least one of said first shelf includes an upwardly facing convex surface,and said second shelf includes an upwardly facing concave surface.

15. The mounting bracket of claim 14, wherein said first shelf and said second shelf extend horizontally from said base member.

16. The mounting bracket of claim 14, wherein said first retaining peg and said second retaining peg project upwardly from said first shelf and said second shelf, respectively.

* * * * *